US012232663B2

(12) United States Patent
Yu

(10) Patent No.: US 12,232,663 B2
(45) Date of Patent: Feb. 25, 2025

(54) SURROUND TYPE BABY BATH SEAT

(71) Applicant: Taizhou Jingtong Maternal and Baby Products Co., Ltd., Taizhou (CN)

(72) Inventor: Xiaoting Yu, Taizhou (CN)

(73) Assignee: Taizhou Jingtong Maternal and Baby Products Co., Ltd., Taizhou (CN)

( * ) Notice: Subject to any disclaimer, the term of this patent is extended or adjusted under 35 U.S.C. 154(b) by 0 days.

(21) Appl. No.: 18/760,278

(22) Filed: Jul. 1, 2024

(65) Prior Publication Data

US 2024/0349953 A1 Oct. 24, 2024

(30) Foreign Application Priority Data

Aug. 18, 2023 (CN) ..... 202322227097.7

(51) Int. Cl.
*A47K 3/12* (2006.01)

(52) U.S. Cl.
CPC ..... *A47K 3/127* (2013.01); *A47K 3/122* (2013.01)

(58) Field of Classification Search
CPC ..... A47K 3/127; A47K 3/024; A47K 3/034; A47K 3/064; A47K 3/074; A47K 3/001; A47D 1/10; A47D 13/027; A47D 13/025
See application file for complete search history.

(56) References Cited

U.S. PATENT DOCUMENTS

| | | | | |
|---|---|---|---|---|
| 4,568,122 | A * | 2/1986 | Kain | B60N 2/2866 297/487 |
| 5,010,606 | A * | 4/1991 | Bernstein | A47K 3/127 4/572.1 |
| 5,317,765 | A * | 6/1994 | Knoedler | A47K 3/127 D23/304 |
| 9,326,641 | B2 * | 5/2016 | Murphy | A47K 3/12 |
| D991,417 | S * | 7/2023 | Chen | D23/278 |
| D1,011,487 | S * | 1/2024 | Yu | D23/278 |
| 2005/0091741 | A9 | 5/2005 | Sundberg et al. | |
| 2005/0229302 | A1 | 10/2005 | Sundberg et al. | |
| 2024/0016343 | A1 | 1/2024 | Chicca et al. | |

FOREIGN PATENT DOCUMENTS

| | | | | |
|---|---|---|---|---|
| GB | 2522334 | A * | 7/2015 | A47D 1/00 |

* cited by examiner

*Primary Examiner* — Erin Deery
(74) *Attorney, Agent, or Firm* — Hemisphere Law, PLLC; Zhigang Ma

(57) ABSTRACT

The present disclosure provides a surround type baby bath seat, including: a seat main body, two armrests, and a locking mechanism. The seat main body includes a base, a middle supporting column located at a front end of the base, and a backrest seat located at a rear end of the base. One end of each armrest is rotatably connected to the backrest seat, and the other end of the armrest is detachably connected to the middle supporting column through the locking mechanism. The surround type baby bath seat is easy to use. The button is arranged at the front end, so that a baby cannot touch the button, thus further improving the safety.

13 Claims, 10 Drawing Sheets

SURROUND TYPE BABY BATH SEAT

TECHNICAL FIELD

The present disclosure relates to the technical field of baby seat equipment, and in particular, to a surround type baby bath seat.

BACKGROUND

At present, most of baby bath seats on the market use an open structure. Namely, the baby bath seat is provided with armrests on a front side and a backrest at a rear end, and the middle is connected through a main body. A baby sits on the main body. During use, force bearing points of the product are located at front and rear ends. The disadvantage of this structure is that a baby can only rely on the armrests at the front end and the backrest at the rear end to support the body, but the baby does not have safety awareness and self control, so that it cannot ensure that the baby will not slip and climb out from both sides of the seat during use, causing drowning. Therefore, the existing baby bath seats cannot fully surround a baby in terms of the structural design, which poses significant safety hazards.

SUMMARY

The present disclosure aims to overcome the defects and shortcomings in the prior art, and provides a surround type baby bath seat.

An embodiment of the present disclosure provides a surround type baby bath seat, including: a seat main body, two armrests, and a locking mechanism, wherein the seat main body includes a base, a middle supporting column located at a front end of the base, and a backrest seat located at a rear end of the base; one end of each armrest is rotatably connected to the backrest seat; and the other end of the armrest is detachably connected to the middle supporting column through the locking mechanism.

In some optional implementations, the locking mechanism includes a sphere member, a button, a lock piece, and a trapezoidal switch element;

the sphere member is arranged at a top of the supporting column; the lock piece is arranged in the sphere member; the lock piece is provided with a lock tongue and a first slope; the trapezoidal switch element is provided with a second slope that is in driving fit with the first slope; an elastic member is further arranged on an inner side of the sphere member; an elastic force of the elastic member can drive the lock piece to always rise upwards; the button is arranged at a front end of the sphere member; the trapezoidal switch element is arranged on one side of the button; and a locking hole position that is in locking fit with the lock tongue is arranged at a lower end of the other side of each armrest.

In some optional implementations, guide columns are respectively arranged at two ends of a bottom of the lock piece; two limiting holes are provided at a bottom of the sphere member; and the guide columns correspondingly pass through the limiting holes.

In some optional implementations, two elastic guide column limiting blocks are arranged at bottom ends of the guide columns; the two elastic guide column limiting blocks can be close to or far from each other; and the elastic guide column limiting blocks are arranged below the limiting holes, so that the guide columns can be prevented from being separated from the limiting holes.

In some optional implementations, supporting steps are arranged in the limiting holes; the elastic member extends into the limiting holes; and a bottom end of the elastic member resists against tops of the supporting steps.

In some optional implementations, two limiting points are arranged on a rear side of the lock piece; a limiting box located behind the lock piece is arranged in the sphere member; and the limiting box resists against the rear side of the lock piece.

In some optional implementations, a mounting shaft hole is arranged on one side of the backrest seat; the mounting shaft hole is funnel-shaped; and bottom ends of the armrests are matched with a shape of the mounting shaft hole.

Compared with the prior art, the surround type baby bath seat of the present disclosure uses a structural design of arranging the armrests on two sides to form the surround type baby bath seat, which can prevent a baby from slipping out from the two sides during bathing and improves the safety. Front ends of the armrests are detachably connected to the middle supporting column through the locking mechanism, so that the armrests can be opened or mounted by one stroke through the button. The surround type baby bath seat is very easy to use. In the present disclosure, the button is arranged at the front end, so that a baby cannot touch the button, thus further improving the safety.

For a clearer understanding of the present disclosure, specific implementations of the present disclosure are described below in combination with the accompanying drawings.

DESCRIPTIONS OF REFERENCE NUMERALS

1: seat main body; 10: base; 11: middle supporting column; 12: backrest seat; 13: mounting shaft; 14: notch; 20: armrest; 21: locking hole position; 22: raised wall ring; 30: locking mechanism; 31: sphere member; 311: limiting hole; 312: supporting step; 313: limiting box; 314: opening; 32: button; 33: lock piece; 331: lock tongue; 332: first slope; 333: guide column; 334: guide column limiting block; 335: limiting point; 34: trapezoid switch member; 341: second slope; and 35: elastic member.

DETAILED DESCRIPTION OF THE EMBODIMENTS

The technical solutions in the embodiments of the present disclosure will be clearly and completely described below with reference to the drawings in the embodiments of the present disclosure, and it is obvious that the described embodiments are only a part of the embodiments of the present disclosure but not all of them. All other embodiments obtained by a person of ordinary skill in the art based on the embodiments of present disclosure without making creative efforts shall fall within the protection scope of present disclosure. The terms "first" and "second" are used for descriptive purposes only and are not to be construed as indicating or implying relative importance or to implicitly indicate the number of technical features indicated. From this, features defined as "first" and "second" may explicitly or implicitly include at least one feature. In the description of the present disclosure, "plurality" means at least two, for example, two and three, unless explicitly specified otherwise. "Several" means one or more.

Figure 1:
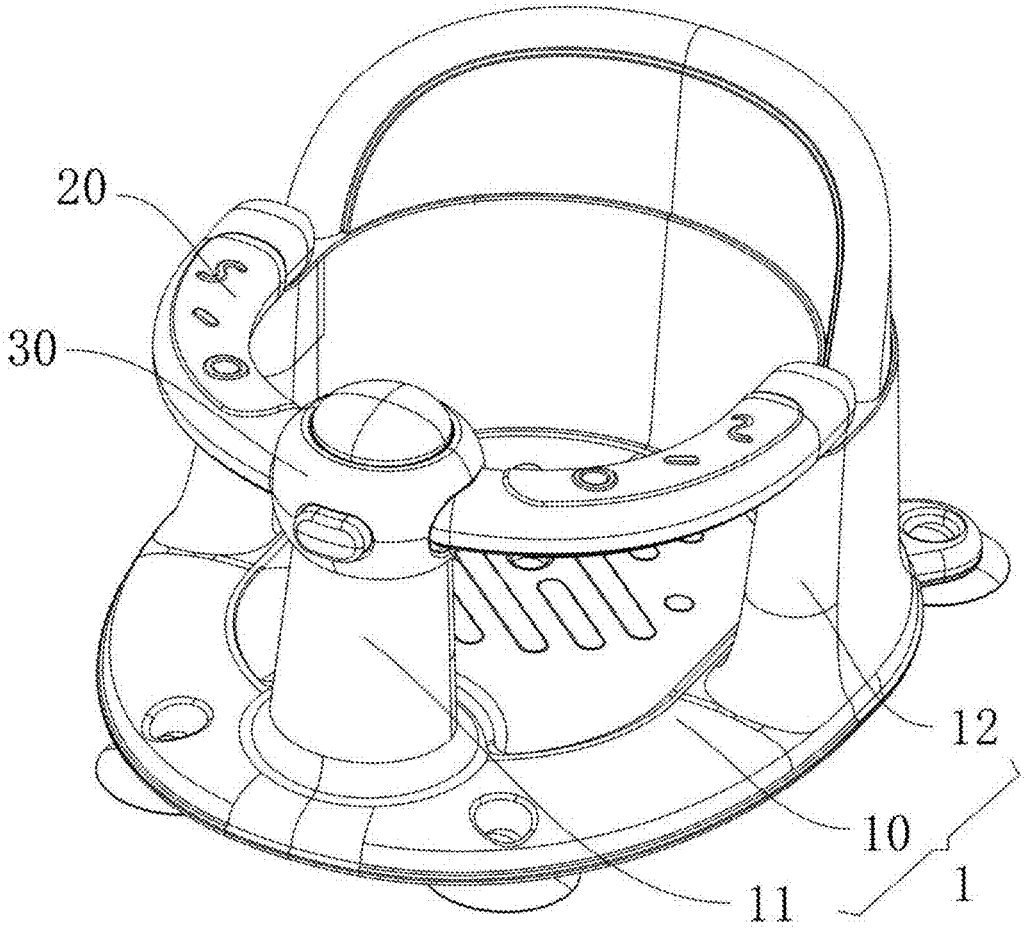
FIG. 1 is a schematic structural diagram of a surround type baby bath seat according to an embodiment of the present disclosure.
Figure 2:
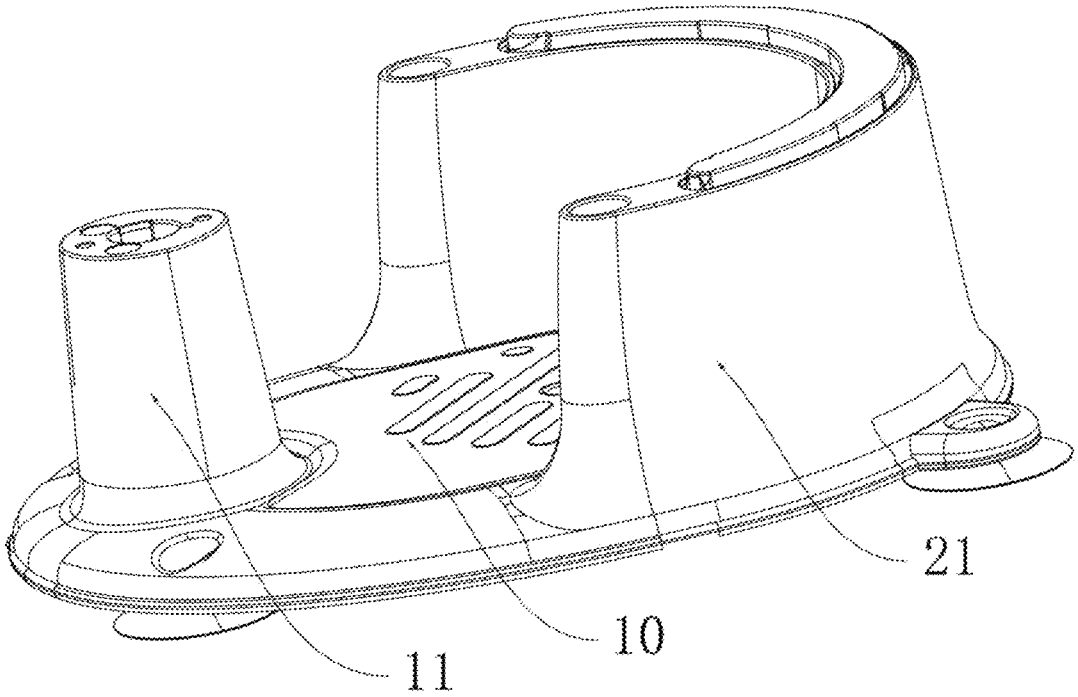
FIG. 2 is a schematic structural diagram of a seat main body according to an embodiment of the present disclosure.
Figure 3:
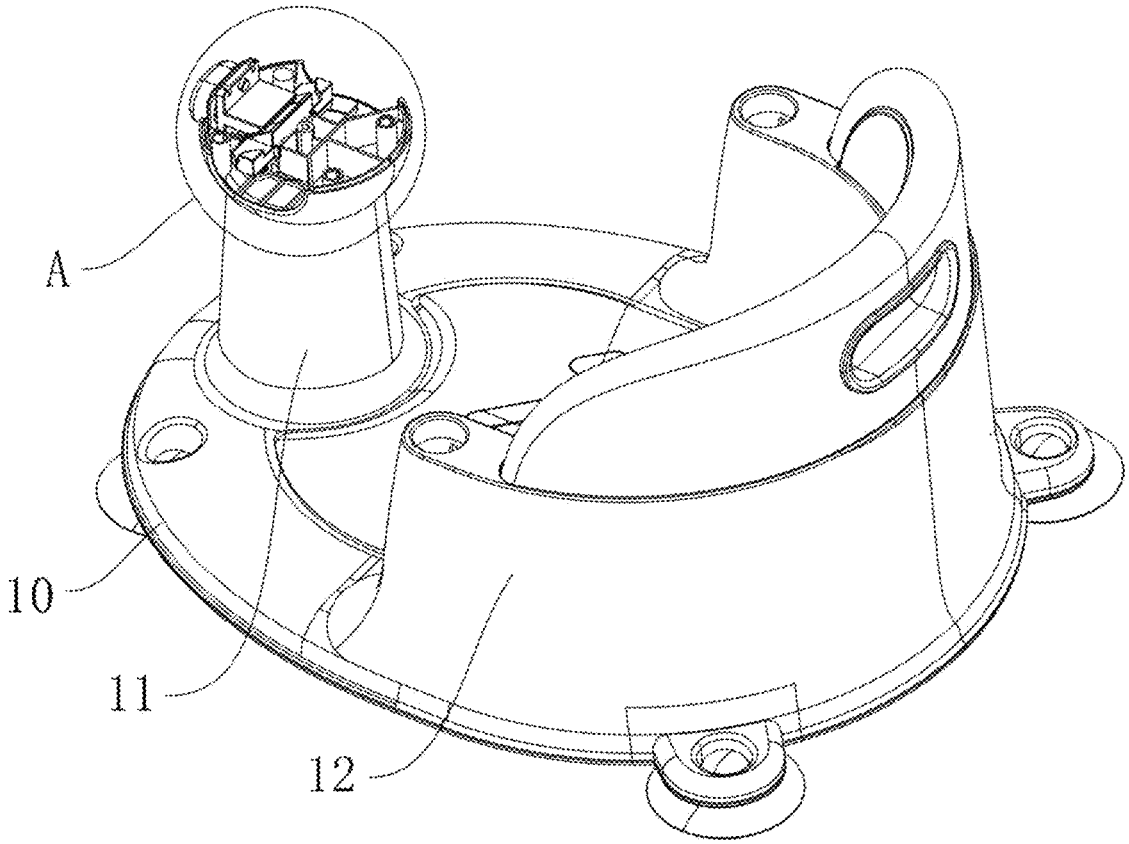
FIG. 3 is a schematic structural diagram of a surround type baby bath seat according to an embodiment of the present disclosure when some structures are hidden.
Figure 4:
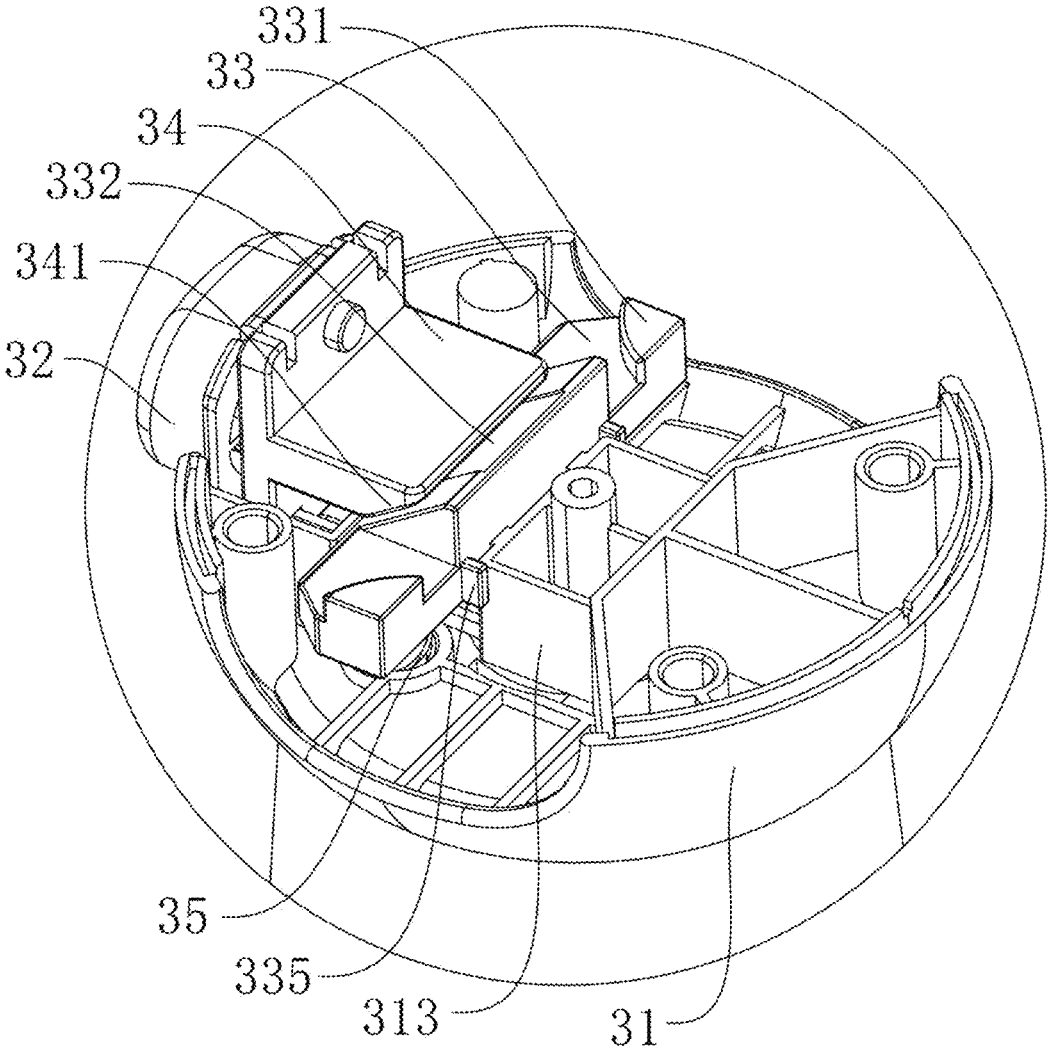
FIG. 4 is an enlarged view of part A in FIG. 3.
Figure 5:
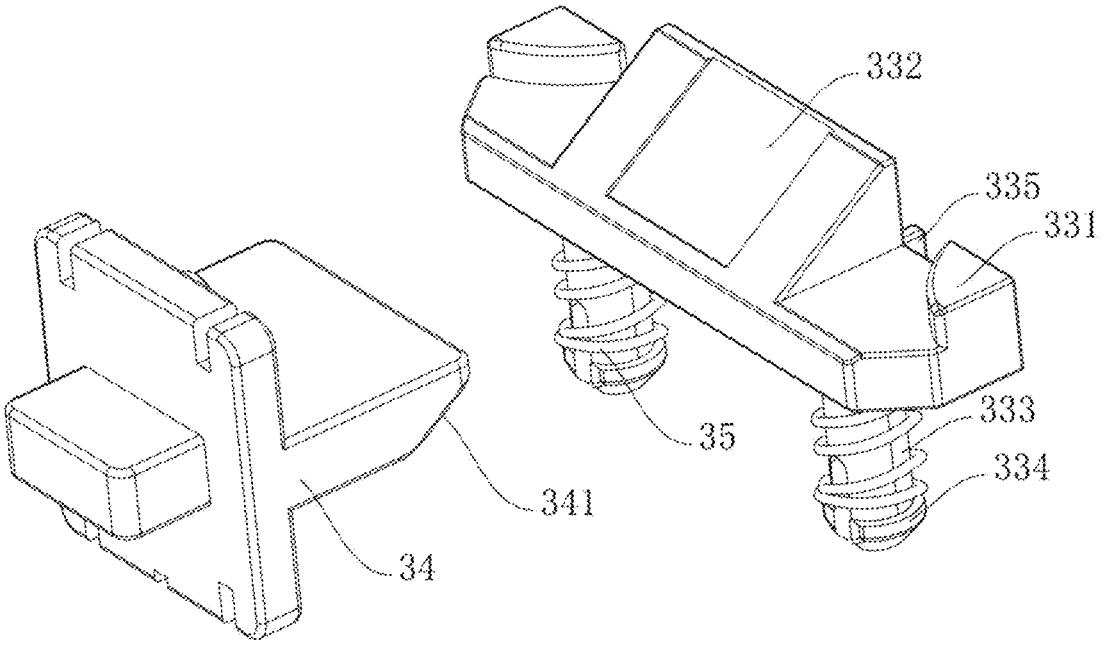
FIG. 5 is an exploded diagram of a lock piece and a trapezoidal switch element according to an embodiment of the present disclosure.
Figure 6:
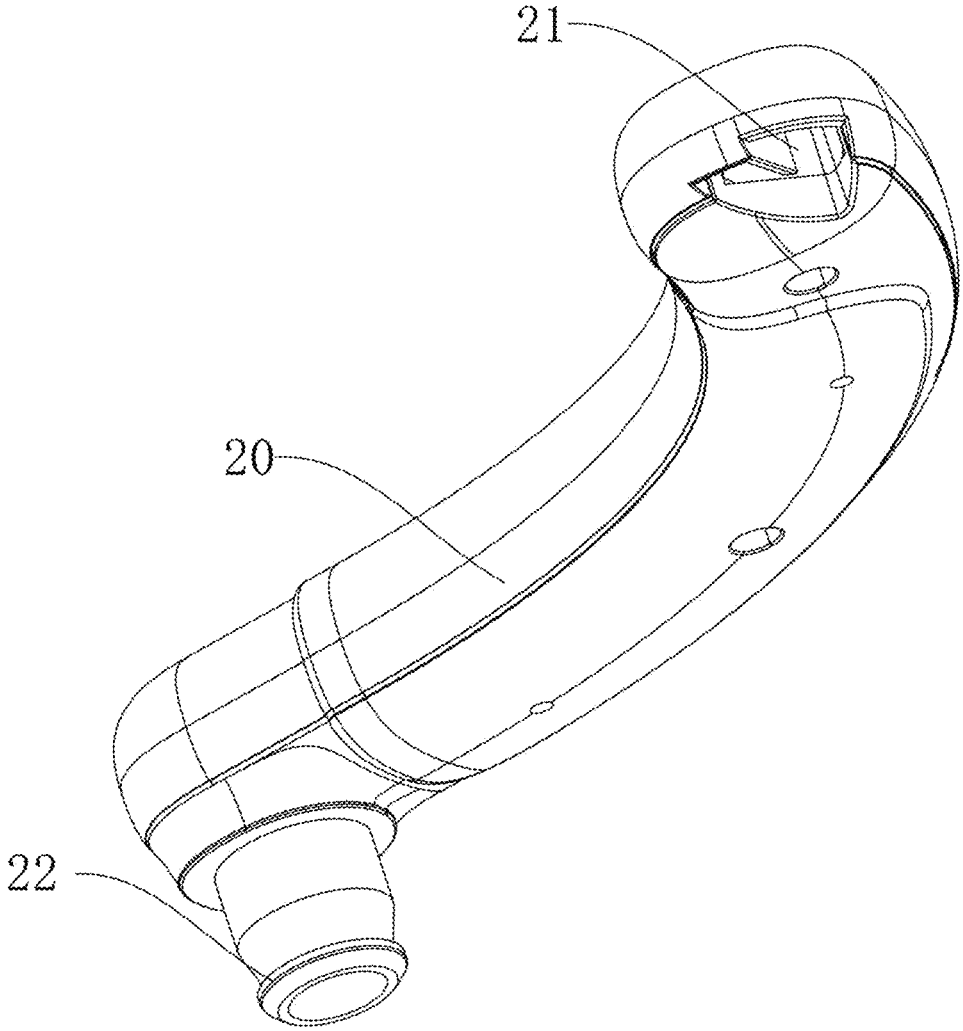
FIG. 6 is a schematic structural diagram of an armrest according to an embodiment of the present disclosure.
Figure 7:
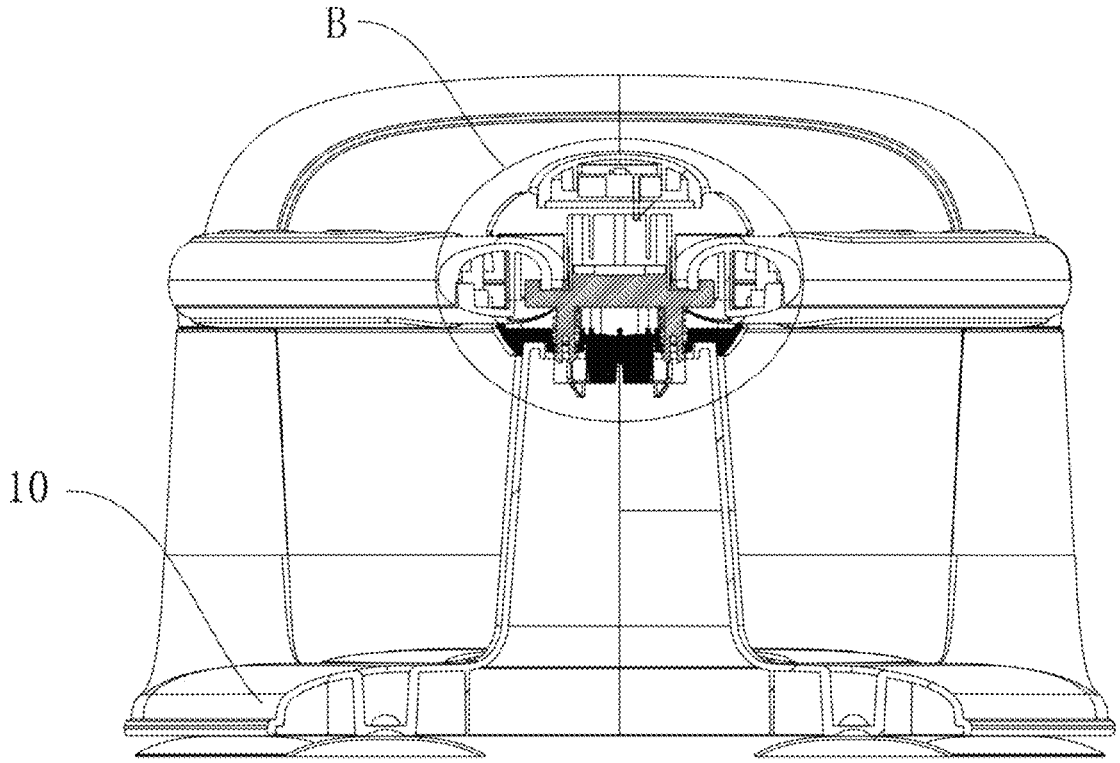
FIG. 7 is a sectional view of a surround type baby bath seat according to an embodiment of the present disclosure.
Figure 8:
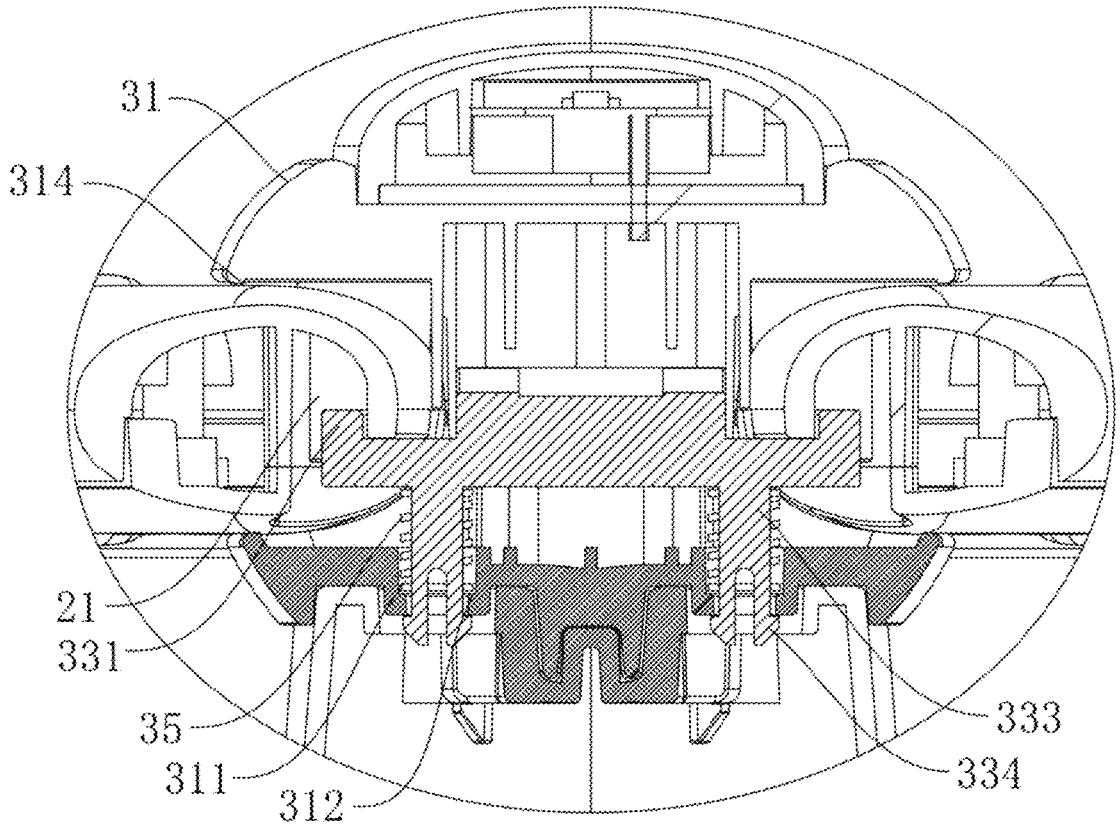
FIG. 8 is an enlarged view of part B in FIG. 5.
Figure 9:
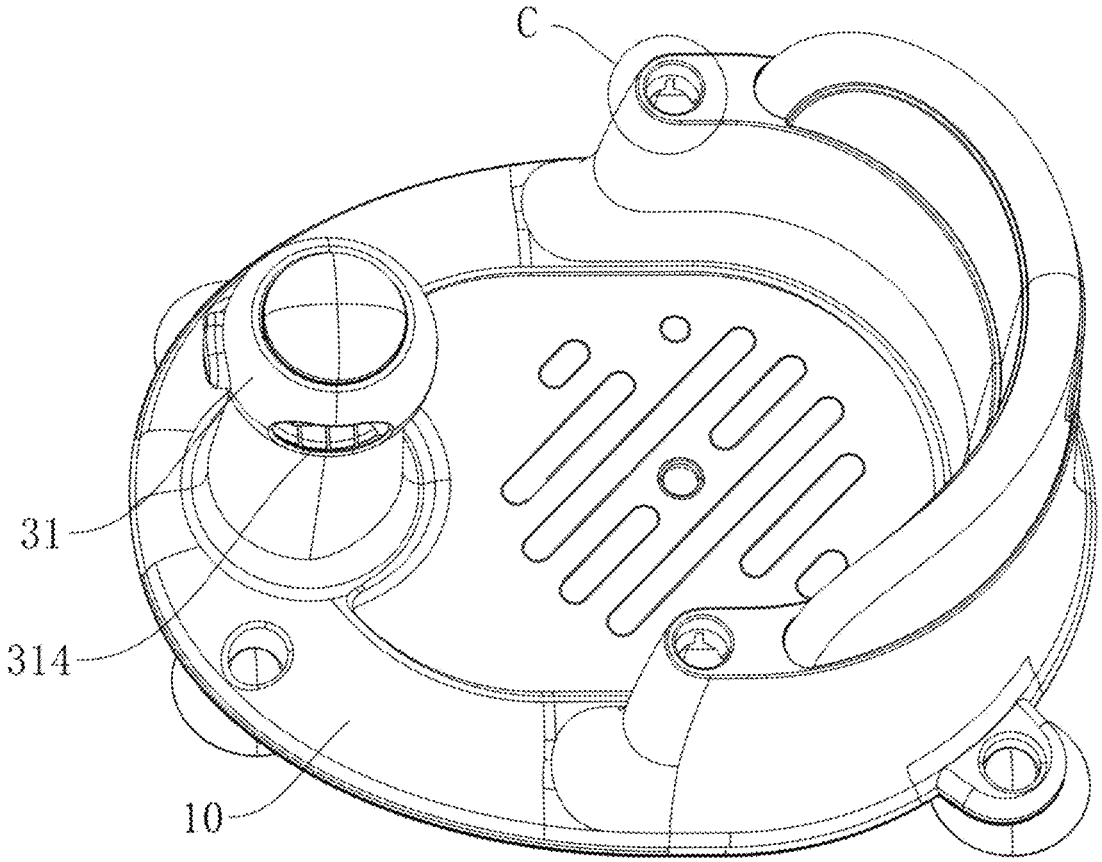
FIG. 9 is a schematic structural diagram of a surround type baby bath seat according to an embodiment of the present disclosure when armrests are hidden.
Figure 10:
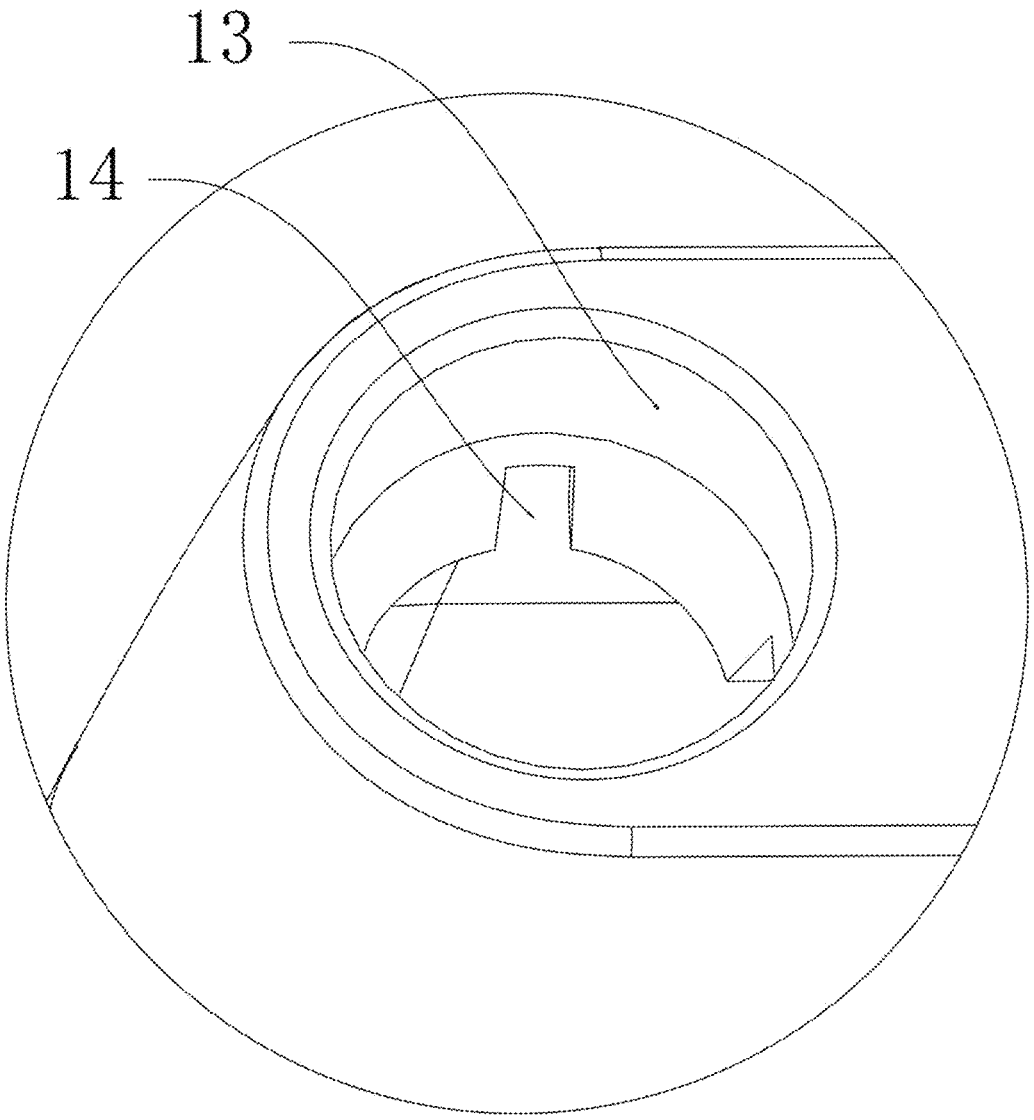
FIG. 10 is an enlarged view of part C in FIG. 7.

Referring to FIG. 1 and FIG. 2, a surround type baby bath seat includes: a seat main body 1, two armrests 20, and a locking mechanism 30. The seat main body 1 includes a base 10, a middle supporting column 11 located at a front end of the base 10, and a backrest seat 12 located at a rear end of the base 10; one end of each armrest 20 is rotatably connected to the backrest seat 12; and the other end of the armrest 20 is detachably connected to the middle supporting column 11 through the locking mechanism 30. According to the surround type baby bath seat of the present disclosure, the armrests 20 are arranged on the two sides to form the surround type baby bath seat, and are locked by the locking mechanism 30, so that a baby can be prevented from slipping out from the two sides during bathing, and the safety is improved.

Referring to FIG. 3 to FIG. 10, in some optional implementations, the locking mechanism 30 includes a sphere member 31, a button 32, a lock piece 33, and a trapezoidal switch element 34; the sphere member 31 is arranged at a top of the supporting column; the lock piece 33 is arranged in the sphere member 31; the lock piece 33 is provided with a lock tongue 331 and a first slope 332; the trapezoidal switch element 34 is provided with a second slope 341 that is in driving fit with the first slope 332; an elastic member 35 is further arranged on an inner side of the sphere member 31; an elastic force of the elastic member 35 can drive the lock piece 33 to always rise upwards; the button 32 is arranged at a front end of the sphere member 31; the trapezoidal switch element 34 is arranged on one side of the button 32; and a locking hole position 21 that is in locking fit with the lock tongue 331 is arranged at a lower end of the other side of each armrest 20. When the button 32 is pressed, the button 32 can drive the trapezoidal switch element 34, so as to drive the lock piece 33 to fall or rise. The falling of the lock piece 33 can unlock the lock tongue 331 and the locking hole position 21, and the rising of the lock piece 33 can lock the lock tongue 331 and the locking hole position 21. A mounting shaft hole 13 is provided on one side of the backrest seat. A raised wall ring 22 is arranged at a position, corresponding to the mounting shaft hole 13, at a bottom end of each armrest 20. The bottom end of the armrest 20 can be inserted into the mounting shaft hole 13 and rotates by using the mounting shaft hole 13 as an axis. The raised wall ring 22 is located below the mounting shaft hole 13, so that the armrest 20 cannot be separated from the mounting shaft hole 13. According to the surround type baby bath seat of the present disclosure, on a mounting structure of the armrests 20, the bottom ends of the armrests 20 are rotatably connected by the cooperation between the mounting shaft hole 13 and the raised wall rings 22, so that the fixing is convenient. Front ends of the armrests 20 are detachably connected to the middle supporting column 11 through the locking mechanism 30, so that the armrests 20 can be opened or mounted by one stroke through the button 32. The surround type baby bath seat is very easy to use. In the present disclosure, the button 32 is arranged at the front end, so that a baby cannot touch the button, thus further improving the safety.

In some optional implementations, guide columns 333 are respectively arranged at two ends of a bottom of the lock piece 33; two limiting holes 311 are provided at a bottom of the sphere member 31; and the guide columns 333 correspondingly pass through the limiting holes 311. The guide columns 333 and the limiting holes 311 are in sliding fit, so that the lock piece 33 moves up and down.

In some optional implementations, two elastic guide column limiting blocks 334 are arranged at bottom ends of the guide columns 333; the two elastic guide column limiting blocks 334 can be close to or far from each other; and the elastic guide column limiting blocks 334 are arranged below the limiting holes 311, so that the guide columns 333 can be prevented from being separated from the limiting holes 311.

In some optional implementations, the elastic member 35 is a spring. The spring sleeves an outer side of the guide column 333, thus facilitating the mounting of the spring.

In some optional implementations, supporting steps 312 are arranged in the limiting holes 311; the spring extends into the limiting holes 311; and a bottom end of the spring resists against tops of the supporting steps 312, thus facilitating the positioning of the spring.

In some optional implementations, two limiting points 335 are arranged on a rear side of the lock piece 33; a limiting box 313 located behind the lock piece 33 is arranged in the sphere member 31; and the limiting box 313 resists against the rear side of the lock piece 33. The two limiting points 335 respectively resist against the two sides of the limiting box 313. After the button 32 is pressed, the button 32 and the trapezoidal switch element 34 apply a force to the lock piece 33 behind, and the limiting box 313 can block the lock piece 33 from the back and cooperate with the two limiting points 335 of the lock piece 33, so that the force applied to the lock piece 33 by the button 32 through the trapezoidal switch element 34 can be stably converted into a downward force, but a left or right or backward force will not be generated, thus improving the stability of the lock piece 33.

In some optional implementations, the mounting shaft hole 13 is funnel-shaped; bottom ends of the armrests 20 are matched with a shape of the mounting shaft hole 13. A diameter of a bottom end of the mounting shaft hole 13 is less than a diameter of each raised wall ring 22. A plurality of notches 14 are provided at the bottom end of the mounting shaft hole 13. When the bottom ends of the armrests 20 are inserted into the mounting shaft hole 13, a portion of the mounting shaft hole 13 located around the notches 14 can have elastic deformation, so that the raised wall rings 22 can move to a position below the mounting shaft hole 13. After the raised wall rings 22 cross the notches 14, the portion of the mounting shaft hole 13 located around the notches 14 returns to the original position, so that the raised wall rings 22 cannot return into the mounting shaft hole 13, thus ensuring that the armrests 20 cannot fall off from the mounting shaft hole 13 after being mounted.

In some optional implementations, the sphere member 31 is detachably connected to the middle supporting columns 11 through a buckle structure.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

What is claimed is:

1. A baby bath seat, comprising: a seat main body, two armrests, and a locking mechanism, wherein the seat main body comprises a base, a middle supporting column located at a front end of the base, and a backrest seat located at a rear end of the base; one end of each armrest is rotatably connected to the backrest seat; and the other end of each armrest is detachably connected to the middle supporting column through the locking mechanism;

wherein the locking mechanism comprises a sphere member and a lock piece;

the sphere member is arranged at a top of the supporting column; the lock piece is arranged in the sphere member; an elastic member is arranged in the sphere member; an elastic force of the elastic member is capable of driving the lock piece to move upwards.

2. The surround type baby bath seat according to claim 1, wherein the locking mechanism further comprises a button and a trapezoidal switch element;

the lock piece is provided with a lock tongue and a first slope; the trapezoidal switch element is provided with a second slope that is in driving fit with the first slope; the button is arranged at a front end of the sphere member; the trapezoidal switch element is arranged on one side of the button; and a locking hole position that is in locking fit with the lock tongue is arranged at a lower end of the other side of each armrest.

3. The baby bath seat according to claim 2, wherein guide columns are respectively arranged at two ends of a bottom of the lock piece; two limiting holes are provided at a bottom of the sphere member; and the guide columns are configured to move correspondingly in the limiting holes.

4. The baby bath seat according to claim 3, wherein two elastic guide column limiting blocks are arranged at bottom ends of the guide columns; the two elastic guide column limiting blocks are able to be adjacent to or spaced apart from each other; and the elastic guide column limiting blocks are arranged below the limiting holes, so that preventing the guide columns from being separated from the limiting holes.

5. The baby bath seat according to claim 4, wherein supporting steps are arranged in the limiting holes; the elastic member is partially received in the limiting holes; and a bottom end of the elastic member resists against tops of the supporting steps.

6. The baby bath seat according to claim 2, wherein two limiting points are arranged on a rear side of the lock piece; a limiting box located behind the lock piece is arranged in the sphere member; and the limiting box resists against the rear side of the lock piece and the two limiting points resist against two opposite sides of the limiting box respectively.

7. The baby bath seat according to claim 3, wherein two limiting points are arranged on a rear side of the lock piece; a limiting box located behind the lock piece is arranged in the sphere member; and the limiting box resists against the rear side of the lock piece and the two limiting points resist against two opposite sides of the limiting box respectively.

8. The baby bath seat according to claim 4, wherein two limiting points are arranged on a rear side of the lock piece; a limiting box located behind the lock piece is arranged in the sphere member; and the limiting box resists against the rear side of the lock piece and the two limiting points resist against two opposite sides of the limiting box respectively.

9. The baby bath seat according to claim 5, wherein two limiting points are arranged on a rear side of the lock piece; a limiting box located behind the lock piece is arranged in the sphere member; and the limiting box resists against the rear side of the lock piece and the two limiting points resist against two opposite sides of the limiting box respectively.

10. The baby bath seat according to claim 2, wherein a mounting shaft hole is arranged on each of two opposite sides of the backrest seat; the mounting shaft hole is funnel-shaped; and a bottom end of each armrest is matched with a shape of the mounting shaft hole.

11. The baby bath seat according to claim 3, wherein a mounting shaft hole is arranged on each of two opposite sides of the backrest seat; the mounting shaft hole is funnel-shaped; and a bottom end of each armrest is matched with a shape of the mounting shaft hole.

12. The baby bath seat according to claim 4, wherein a mounting shaft hole is arranged on each of two opposite sides of the backrest seat; the mounting shaft hole is funnel-shaped; and a bottom end of are each armrest is matched with a shape of the mounting shaft hole.

13. The baby bath seat according to claim 5, wherein a mounting shaft hole is arranged on each of two opposite sides of the backrest seat; the mounting shaft hole is funnel-shaped; and a bottom end of each armrest is matched with a shape of the mounting shaft hole.

* * * * *